United States Patent [19]

Goerlich et al.

[11] Patent Number: 4,944,153

[45] Date of Patent: Jul. 31, 1990

[54] BURNER FOR HARD-TO-IGNITE MIXTURES

[75] Inventors: Dieter Goerlich, Emmering; Rainer Kolodzie; Rainer Reiter, both of Munich, all of Fed. Rep. of Germany

[73] Assignee: Webasto AG Fahrzeugtechnik, Fed. Rep. of Germany

[21] Appl. No.: 235,292

[22] Filed: Aug. 23, 1988

[30] Foreign Application Priority Data

Aug. 28, 1987 [DE] Fed. Rep. of Germany ..... 3728712

[51] Int. Cl.[5] ..... F01N 3/02

[52] U.S. Cl. ..... 60/303; 60/39.826; 60/39.827; 60/286

[58] Field of Search ..... 60/303, 286, 39.826, 60/39.827

[56] References Cited

U.S. PATENT DOCUMENTS

| | | | |
|---|---|---|---|
| 1,839,880 | 1/1932 | Hyatt | 60/39.826 |
| 2,385,833 | 10/1945 | Nahigyan | 60/39.826 |
| 4,450,682 | 5/1984 | Sato | 60/303 |
| 4,520,624 | 6/1985 | Kiyota | 60/303 |
| 4,571,938 | 2/1986 | Sakurai | 60/303 |
| 4,662,172 | 5/1987 | Shinzawa | 60/303 |

FOREIGN PATENT DOCUMENTS

| | | | |
|---|---|---|---|
| 3145028 | 5/1983 | Fed. Rep. of Germany | 60/303 |

*Primary Examiner*—Douglas Hart

*Attorney, Agent, or Firm*—Sixbey, Friedman, Leedom & Ferguson

[57] ABSTRACT

A burner for hard-to-ignite mixtures, such as with exhaust gases of an internal combustion engine, in which an ignitable mixture is prepared in a locally limited area for producing an ignition flame that is then used for igniting the hard-to-ignite mixture. According to one embodiment, the burner has an auxiliary ignition burner that is integrated into the actual burner and that is operated with compressed air, which is delivered either by a vehicle compressed air system or by a separately provided air compressor. In an alternative embodiment, air is fed in, additionally, by an air injection device to an outlet area of the fuel nozzle and in the vicinity of the ignition device to prepare an extremely ignitable mixture in this area, which is used to generate an ignition flame. The air injection device can be supplied with compressed air in the same manner as for the auxiliary ignition burner in the first embodiment. Alternatively, ambient air with sufficient oxygen content can be fed in through the air injection device.

11 Claims, 2 Drawing Sheets

BURNER FOR HARD-TO-IGNITE MIXTURES

BACKGROUND OF THE INVENTION

The invention relates to a burner for hard-to-ignite mixtures, such as exhaust gases of an internal combustion engine.

The term "hard-to-ignite mixtures," as used herein in connection with the invention, means mixtures that contain either little oxygen or fuels that are hard to burn, i.e., are relatively incombustible in comparison to typical fuels, such as fuel oils, kerosene and gasoline. A filtering device in the exhaust gas tract of a diesel internal combustion engine in which a so called exhaust gas burner is used, to combust a mixture wherein exhaust gases serve as the combustion air source (i.e., as the oxygen carrier), for producing heat that will cause regeneration of the filtering unit by burning off accumulated soot particles and the like, is an important example of a situation where a need to combust a hard-to-ignite mixture exists, and is described in commonly owned U.S. patent applications Ser. Nos. 196, 557 and 196,558 by one of the present co-inventors, filed on May 20, 1988.

In such exhaust gas filtering units of diesel engines, the quantity of oxygen in the exhaust gas is subject to great fluctuations and these fluctuations are especially dependent on the momentary operating point in the engine family of characteristics. However, if the oxygen content in the exhaust gas is small, igniting such a burner causes extremely great difficulties, even with good mixing of fuel and exhaust gas. With good, thorough mixing, the residual oxygen can support combustion. However, igniting of the mixture is practically impossible, or possible only with great ignition energy.

SUMMARY OF THE INVENTION

The invention aims to overcome the difficulties described above, by providing a burner for hard-to-ignite mixtures that can be ignited reliably. In particular, it is an object of the invention to enable, especially in the example of the application of the burner to an exhaust gas filtering unit, the regeneration of the filters to be carried out, if need be, independently of the quantity oxygen in the exhaust gas serving as the fuel for the burner.

According to the invention, a burner for hard-to-ignite mixtures, such as exhaust gases of an internal combustion engine, is provided with an auxiliary ignition burner that can be supplied with compressed air. By means of such an auxiliary ignition burner, that has appropriately small dimensions and a low output in comparison with the actual main burner to be ignited, an extremely ignitable mixture can be prepared with little air consumption in the area of the auxiliary ignition burner by means of the oxygen present in the compressed air, and then the hard-to-ignite mixture can be ignited reliably by means of the energy delivered by the auxiliary ignition burner that serves as an ignition device for the main burner. In this way, operational breakdowns in igniting an exhaust gas burner can be avoided and the regeneration of an exhaust gas filtering unit can be started and carried out even when the oxygen content in the exhaust gas is small.

The auxiliary ignition burner is, preferably, integrated into the main burner for the hard-to-ignite mixture, so that a compact construction is obtained and a complete unit for the combustion of hard-to-ignite mixtures is obtained.

Depending on the circumstances of use and the structural conditions, the compressed air can be delivered by a vehicle compressed air system, or a separate air compressor or blower can be allocated to the auxiliary ignition burner that, of course, is then dimensioned no larger than necessary to fulfill the small air consumption requirements for the operation of the auxiliary ignition burner. In either case, optionally, air storage devices, such as containers for compressed air used in connection with pressurized air breaking systems, may be provided as well.

With a burner for hard-to-ignite mixtures, such as of fuel with exhaust gases of an internal combustion engine, that has an ignition device and a fuel nozzle, a second, independent, approach to solving of the initially mentioned problems, according to the invention, is achieved by providing an additional air injection device, instead of an auxiliary burner. The air injection device delivers air into proximity with the outlet area of the fuel nozzle. In this case, an extremely ignitable mixture is prepared in the vicinity of the ignition device, which, e.g., consists of ignition electrodes in the area of the fuel nozzle, although the quantity of additional air injected is small in relation to the quantity of fuel. In this way, even with a small oxygen content of the combustion gas, a very ignitable mixture is prepared locally by carefully directing the air being fed in through the additional air injection device, so that the ignition device of the burner can ignite such a locally prepared mixture reliably without increased energy consumption.

In this alternative embodiment, the air injection device can supply the air to the area of the fuel nozzle tangentially, radially, axially, or in the form of an annular jet, which, optionally, depends on the structural shape of the burner and/or the fuel nozzle. In this case, as in the first embodiment, the additional air injection device can feed in compressed air that is delivered by the vehicle compressed air system, for example, or a separate air compressor can be provided that supplies the additional air injection device with air, optionally, with an air storage element being provided.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
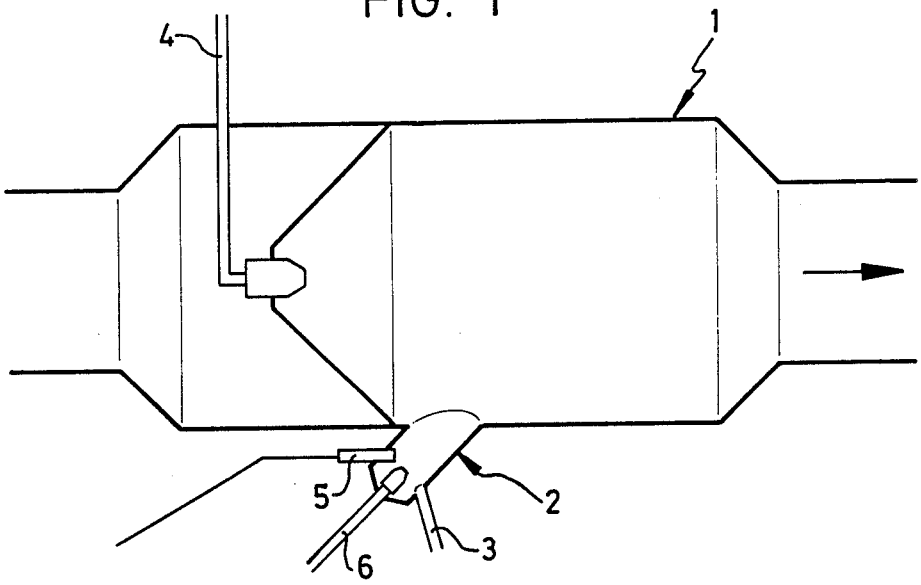
FIG. 1 is a diagrammatic view of a burner with an auxiliary ignition burner.

In FIG. 1, a burner according to the invention is shown, as a whole, identified by reference numeral 1, which is intended for hard-to-ignite mixtures and, particularly, where the burner is to be operated with exhaust gases of an internal combustion engine whose oxygen content changes as a function of engine operating conditions. Burner 1 has a fuel supply device 4 that is diagrammatically depicted in the form of a fuel line with a fuel atomizing nozzle. Additionally, an auxiliary ignition burner 2 is indicated in FIG. 1, in diagrammatic form, as being integrated in burner 1 in the embodiment that is represented. The burner 1 may also have, in the usual way, an ignition device, not shown, that can, e.g., consist of ignition electrodes that can deliver ignition sparks with specific energy into the area of the outlet of fuel supply device 4.

The auxiliary ignition burner 2, in a form that is not represented, can also be constructed as a separate burner, that merely provides ignition energy for ignition of burner 1. Of course, an embodiment is also possible in which the auxiliary ignition burner 2 is placed concentrically in burner 1. In the present case, auxiliary ignition burner 2 has an ignition device 5, a fuel supply device 6, and a compressed air supply device 3 that supplies compressed air to auxiliary ignition burner 2. This compressed air supply device 3 can be connected to a vehicle compressed air system having an air blower or compressor (optionally, with the insertion of an air storage element), so that the compressed air required to operate auxiliary ignition burner 2 is tapped directly from the vehicle compressed air system.

Alternatively, compressed air supply device 3 can also be connected with a separate air compressor, i.e., one having its output dedicated exclusively to supply device 3 (optionally, with the insertion of an air storage element), that produces compressed air for auxiliary ignition burner 2 independently of the vehicle compressed air system. Since auxiliary ignition burner 2 is dimensioned so that it has a small air consumption requirement, an air compressor or blower with a correspondingly small output and small dimensions then suffices for such a separate air compressor. This air compressor, optionally, can also be integrated directly into burner 1, so that the burner according to the invention, seen as a whole, constitutes a complete unit that can be operated as such and mounted at the desired place.

Figure 2:
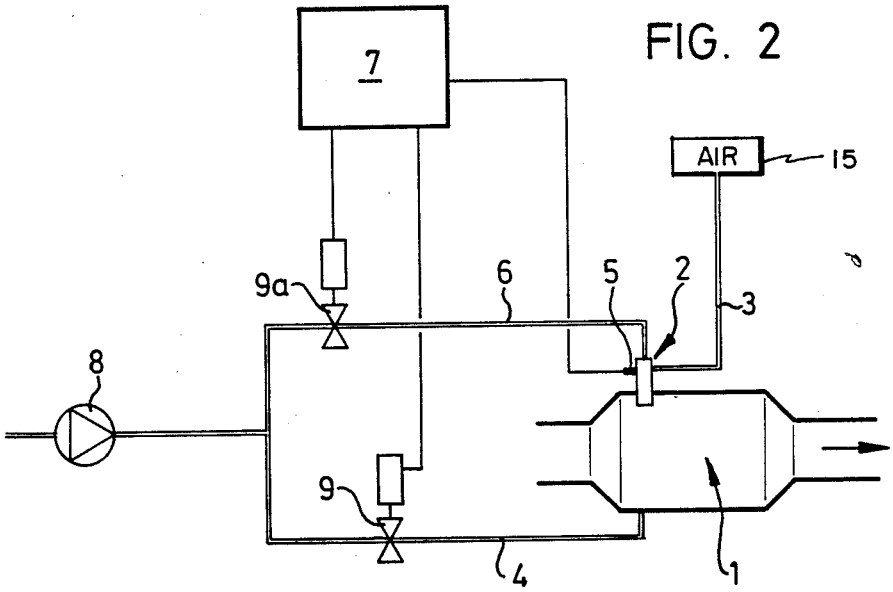
FIG. 2 is a block diagram illustrating a control arrangement for the burner according to FIG. 1.

A control system arrangement for such a burner 1 having an auxiliary ignition burner 2 can be gathered from the block diagram according to FIG. 2. For this purpose, a control device 7 is provided that controls the working of auxiliary ignition burner 2 and that of main burner 1. By means of fuel pump 8, fuel is supplied to both fuel supply device 4 of burner 1 and fuel supply device 6 of ignition auxiliary burner 2 through parallel branch pipes. Solenoid valves 9, **9*a* are each located in a respective one of the parallel branch pipes. These solenoid valves 9, 9*a* are triggered by control device 7, which, further, also triggers ignition device 5 of auxiliary ignition burner 2. Compressed air is delivered to auxiliary ignition burner 2 through compressed air supply device 3. The fuel gas, such as, e.g., a hard-to-ignite mixture, especially those with exhaust gases of an internal combustion engine as the oxygen carrier, is supplied to burner 1, such as by forming the housing H of burner 1 as a segment of an exhaust pipe that forms part of the exhaust line of the engine. Control device 7 opens solenoid valves 9, 9*a* in appropriate chronological sequence when burner 1 starts, so that fuel is supplied to ignition auxiliary burner 2 by fuel pump 8. With an appropriate supply of air being received by means of compressed air supply device 3 from either the vehicle air system or a separate compressed air system, 15), the firing of ignition device 5 is then triggered by control device 7. Now, since the mixture of compressed air and fuel created in proximity to ignition device 5 is an easy to ignite one, an ignition flame is reliably formed, despite a low oxygen content in the exhaust gases, in ignition auxiliary burner 2, and the energy produced by that means is then used for igniting burner 1**.

Figure 3:
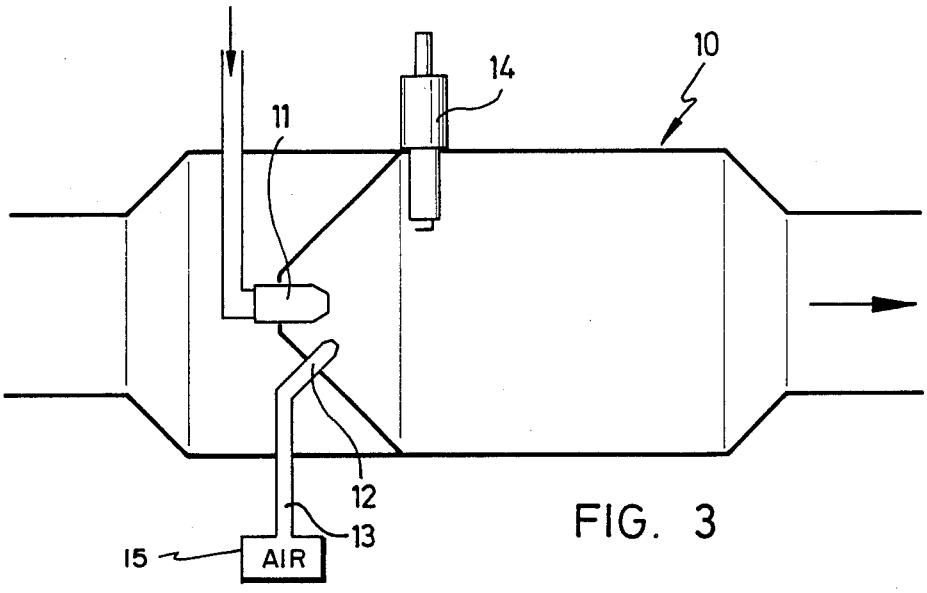
FIG. 3 is a diagrammatic view of a burner with an additional air injection device.

FIG. 3 shows another and independent embodiment for a burner according to the invention that is designated 10, as a whole. In addition to ignition device 14, burner 10 has a fuel nozzle 11 and an additional air injection device 12, the outlet of which is located in proximity to the outlet of nozzle 11. This additional air injection device 12 can direct an air jet at the outlet area of fuel nozzle 11, tangentially, radially, axially, or in the form of an annular jet or combinations thereof, so that an easy-to-ignite fuel mixture with excess air is prepared locally that can be ignited reliably by means of the ignition device 14 provided in burner 10. When a mixture prepared in this way is ignited and a flame has formed, the energy generated in this way also suffices to ignite the hard-to-ignite mixture conveyed to burner 10, so that burner 10 can be operated to generate hot combustion gases with exhaust gases that have a low oxygen content.

Figure 4:
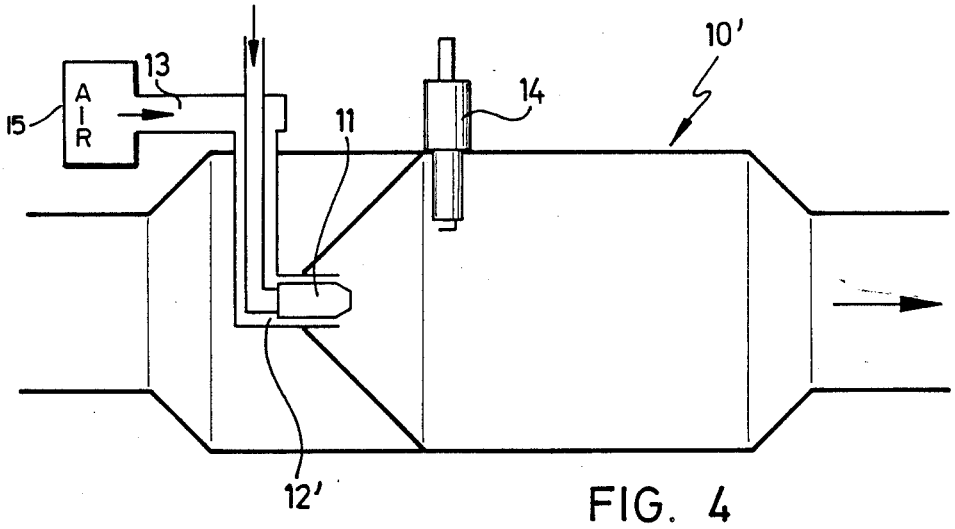
FIG. 4 is a modified embodiment of a burner with an additional air injection device.

In FIG. 4, a modified embodiment of a burner indicated, as a whole, with 10', is shown. Here, parts that are the same or similar parts to those of FIG. 3 are provided with the same reference numerals as in the embodiment according to FIG. 3, but are distinguished through the use of prime (') designations. As an important difference from the embodiment according to FIG. 3, additional air injection device 12' is placed concentrically around fuel nozzle 11' in burner 10' and it delivers an annular jet of air in the outlet area of fuel nozzle 11' . Thus an extremely ignitable mixture is prepared, again, in the outlet area of fuel nozzle 11' and can be ignited by means of ignition device 14' , which is located in proximity thereto.

In FIGS. 3 and 4, additional air injection device 12, 12' is connected with an air supply device 13, 13' that, as in the preceding embodiment of FIGS. 1 and 2, can be connected with either a vehicle compressed air system or with a separate compressed air system 15, optionally with the insertion of storage elements.

Such a burner 1, 10, 10' , as explained above, serves especially as a so-called exhaust gas burner that is installed in an exhaust gas line of an internal combustion engine having an exhaust gas filtering unit to supply hot combustion gases for regeneration of the filter installation and for starting it. Of course, such a burner 1, 10, 10' can also be used when the hard-to-ignite mixture contains a hard-to-burn fuel. Therefore the invention is not limited to the example of a preferred application described above. Instead, numerous other areas of application are possible.

In the layout of the burner according to the invention, it is important that the hard-to-ignite mixture be ignited by a separately produced igniting flame. For this purpose, an extremely ignitable mixture is prepared locally, either with an auxiliary ignition burner 2 or by injecting additional air into an area around fuel nozzle 11, 11', in the immediate vicinity of ignition device 5, 14 of the burner so that the resultant flame can then deliver the ignition energy necessary for igniting the hard-to-ignite mixture.

For further improvement of the stable combustion activity of burner 1, 10, 10', it can be advantageous, with exhaust gas having a low oxygen content, to continue operating auxiliary ignition burner 2, and thus maintain the air supply to it or to maintain the additional air supply to the air injection device 12, even after the main burner has been ignited. Thus, the combustion operation of the burner is influenced directly. On the other hand, the air supply can be turned off after the main burner has been ignited, so that this additional air supply takes place only during starting of the burner.

What is claimed:

1. Burner for a hard-to-ignite mixture, such as exhaust gases of an internal combustion engine, comprising a main burner to which only fuel is supplied to the mixture and an ignition means for providing sufficient energy for ignition of the main burner; wherein said ignition means comprises an air supply device for creation of a local zone of an easy-to-combust mixture and an ignition device for producing a flame therefrom, and control means for turning off said air supply device once ignition of said main burner is achieved.

2. Burner according to claim 1, wherein said ignition means is an auxiliary ignition burner which is integrated into a unit with a main burner for the hard-to-ignite mixture.

3. Burner according to claim 2, wherein the air supply device comprises a means for delivering air from a vehicle compressed air system to said auxiliary ignition burner.

4. Burner according to claim 2, wherein said air supply device comprises a means for delivering air from a separate air compressor to said auxiliary ignition burner.

5. Burner according to claim 1, wherein said main burner and said ignition means are integrated into a unit having a housing in the form of a segment of an exhaust pipe for an exhaust line of an integral combustion engine.

6. Burner according to claim 1, said air supply device comprises an air injection device having an air outlet disposed in an outlet area of a fuel nozzle of said main burner that is in proximity to said ignition device.

7. Burner according to claim 6, wherein said air injection device is constructed for supplying air to the outlet area of the fuel nozzle in at least one of tangential, radial, axial, and annular jet forms.

8. Burner according to claim 7, wherein a compressed air supply device is provided for delivering compressed air to said air injection device.

9. Burner according to claim 8, wherein the compressed air supply device comprises means for delivering air to the air injection device from a vehicle compressed air system.

10. Burner according to claim 8, wherein the compressed air supply device comprises a separate air compressor for delivering compressed air to said air injection device.

11. Burner according to claim 6, wherein said main burner and said ignition means are combined into a unit having a housing in the form of an exhaust pipe segment for an exhaust line of an internal combustion engine.

* * * * *